US005169462A

United States Patent [19]

Morley et al.

[11] Patent Number: 5,169,462

[45] Date of Patent: Dec. 8, 1992

[54] LOW DENSITY ALUMINUM ALLOY FOR ENGINE PISTONS

[75] Inventors: Richard A. Morley; William H. Overbagh, Chesterfield, both of Va.

[73] Assignee: Reynolds Metals Company, Richmond, Va.

[21] Appl. No.: 803,824

[22] Filed: Dec. 9, 1991

[51] Int. Cl.[5] ..... C22C 21/00

[52] U.S. Cl. ..... 148/439; 148/437; 420/528; 420/532; 420/535; 420/539; 420/541; 420/544; 420/551; 420/553

[58] Field of Search ..... 420/528, 529, 532, 534, 420/535, 539, 541, 544, 551, 553; 148/437, 439, 440

[56] References Cited

U.S. PATENT DOCUMENTS 5,032,359 7/1991 Pickens et al. ..... 148/439

*Primary Examiner*—R. Dean
*Assistant Examiner*—Robert R. Koehler
*Attorney, Agent, or Firm*—Alan M. Biddison

[57] ABSTRACT

An aluminum-lithium based alloy which comprises 10–20 wt. % silicon, 1.5–5.0 wt. % copper, 1.0–4.0 wt. % lithium, 0.45–1.5 wt. % magnesium, 0.01–1.3 wt. % iron, 0.01–0.5 wt. % manganese, 0.01–1.5 wt. % nickel, 0.01–1.5 wt. % zinc, 0.01–0.5 wt. % silver, 0.01–0.25 wt. % titanium and the balance aluminum. The alloy is utilized to cast high temperature assemblies including pistons which have a reduction in density and similar mechanical properties including tensile strengths to alloys presently used.

6 Claims, No Drawings

LOW DENSITY ALUMINUM ALLOY FOR ENGINE PISTONS

TECHNICAL FIELD

The present invention relates to aluminum based alloy products having reduced densities. More particularly, the present invention relates to aluminum-lithium alloy compositions and products manufactured therefrom.

BACKGROUND ART

Metallurgists are aware that the addition of lithium reduces the density and increases the modulus of elasticity and mechanical strength of aluminum alloys. That explains the attraction to such alloys for uses in the aeronautical industry. However, it is known that such lithium-containing alloys often have unsatisfactory ductility and toughness.

Heretofore, aluminum-lithium alloys have been used only sparsely in aircraft structure. The relatively low use has been caused by casting difficulties associated with aluminum-lithium alloys and by their relatively low fracture toughness compared to other more conventional aluminum alloys. Aluminum-lithium alloys, however, provide a substantial lowering of density of aluminum alloys (as well as a relatively high strength to weight ratio), which has been found to be very important in decreasing the overall weight of structural materials. While substantial strides have been made in improving the aluminum-lithium processing technology, a major challenge remains to obtain a good blend of fracture toughness and high strength in an aluminum-lithium alloy.

It has been recognized that the elements lithium, beryllium, boron and magnesium can be added to aluminum alloys to decrease the density. However, current methods of production of aluminum alloys, such as direct chill (DC) continuous and semi-continuous casting, have not satisfactorily produced alloys containing more than about 2.5 wt. % lithium or about 0.2 wt. % boron. Magnesium and beryllium contents up to 5 wt. % have been satisfactorily included in aluminum alloys by DC casting, but the alloy properties have generally not been adequate for widespread use in applications requiring a combination of high strength and low density. More particularly, conventional aluminum alloys have not provided the desirable combinations of low density, high strength and toughness.

The inclusion of the elements lithium and magnesium, singly or in concert, may impart higher strength and lower density to the alloys, but they are not of themselves sufficient to produce ductility and high fracture toughness without other secondary elements. Such secondary elements, such as copper and zinc, often provide improved precipitation hardening response; zirconium may additionally provide grain size control by pinning grain boundaries during thermomechanical processing; and elements such as silicon and transition metal elements can provide improved thermal stability at intermediate temperatures up to about 200° C. However, combining these elements in aluminum alloys forms coarse, complex, intermetallic phases during conventional casting. Such coarse phases ranging from about 1–20 micrometers in size, are detrimental to crack-sensitive mechanical properties, such as fracture toughness and ductility, by encouraging fast crack growth under tensile loading.

Thus, considerable effort has been directed to producing low density aluminum base alloys capable of being formed into structural components. However, conventional alloys and techniques have been unable to provide the desired combination of high strength, toughness and low density. As a result, conventional aluminum based alloys have not been entirely satisfactory for structural applications requiring high strength, good ductility and low density as required in particular applications, including high temperature environments such as internal combustion engines.

A number of aluminum based alloys have been developed in efforts to improve their properties. For instance, U.S. Pat. No. 4,681,736 to Kersker et al discloses an aluminum based alloy which includes 14–18 wt. % silicon, 4–6 wt. % copper, up to 1 wt. % magnesium, 0.4–2 wt. % iron, 4.5–10 wt. % nickel. The aluminum alloy of Kersker supposedly has a fine grain structure, is more castable and its resistance to hot cracking is increased. Moreover, the cast alloy supposedly has a greater ductility.

U.S. Pat. No. 3,765,877 to Sperry et al discloses an aluminum based alloy which includes 7–20 wt. % silicon, 3.5–6 wt. % copper, 0.1–0.6 wt. % magnesium, 1.5 wt. % iron, up to 0.7 wt. % manganese, 2.5 wt. % nickel, 0.5 wt. % zinc, 0.1–1 wt. % silver and 0.01–0.25 wt. % titanium. The aluminum alloy of Sperry et al supposedly demonstrates a high strength and wear resistance.

U.S. Pat. No. 1,799,837 to Archer discloses an aluminum based alloy which includes 7–15 wt. % silicon, 0.3–7 wt. % copper, 0.2–3 wt. % magnesium and 0.4–7 wt. % nickel.

U.S. Pat. No. 4,297,976 to Bruni et al discloses an aluminum alloy which includes 12–20 wt. % silicon, 0.5–5 wt. % copper, 0.2–2 wt. % magnesium, 1–6 wt. % iron, 0.5 wt. % manganese, 0.5–4 wt. % nickel and 0–0.3 wt. % titanium. The aluminum alloy of Bruni et al was particularly developed for piston and cylinder assemblies.

U.S. Pat. No. 4,434,014 to Smith discloses an aluminum based alloy which contains 12–15 wt. % silicon, 1.5–5.5 wt. % copper, 0.1–1 wt. % magnesium, 0.1–1 wt. % iron, 0.01–0.1 wt. % manganese, 1–3 wt. % nickel, 0.01–0.1 wt. % titanium. The aluminum alloys of Smith supposedly demonstrate excellent elevated temperature strength properties and a high modulus of elasticity.

In addition to the above-noted U.S. patents, a number of aluminum based alloys which contain lithium have been developed. U.S. Pat. No. 3,081,534 to Bredzs discloses an aluminum based alloy which contains 1.9–10 wt. % silicon, 0–4 wt. % copper and 0.1–1 wt. % lithium. The aluminum-silicon-lithium alloy of Bredzs was particularly developed as a fluxless brazing or soldering material for aluminum.

U.S. Pat. No. 4,795,502 to Cho discloses an aluminum based alloy which includes up to 5 wt. % silicon, 1.6–2.8 wt. % copper, 1.5–2.5 wt. % lithium, 0.7–2.5 wt. % magnesium and 0.5 wt. % iron. The aluminum based alloy of Cho is prepared by a particular process which supposedly results in an uncrystallized sheet product having improved levels of strength and fracture toughness.

U.S. Pat. No. 4,661,172 to Skinner discloses an aluminum based alloy which includes 0.5–5 wt. % silicon, 0.5–5 wt. % copper, 2.7–5 wt. % lithium, 0.5–8 wt. % magnesium, 0.5–5 wt. % iron, 0.5–5 wt. % manganese, 0.5–5 wt. % nickel and 0.5–5 wt. % titanium. Products from the aluminum based alloy of Skinner are prepared as powder alloys which are rapidly solidified from the melt and then thermomechanically processed into the structure of components supposedly having a combination of high ductility and high tensile strength to density ratios.

U.S. Pat. No. 4,648,913 to Hunt discloses an aluminum based metal alloy which includes 0.5 wt. % silicon, 0–5 wt. % copper, 0.5–4 wt. % lithium, 0–0.5 wt. % magnesium, 0.5 wt. % iron, 0.2 wt. % manganese and 0–7 wt. % zinc. The aluminum based alloy of Hunt is prepared by a process which includes an aging step, and includes a working effect equivalent to stretching in an amount greater than 3% so that after aging, an improved strength and fracture toughness is supposedly imparted to the alloy.

U.S. Pat. No. 4,758,286 to Dubost et al discloses an aluminum based alloy which includes 0.12 wt. % silicon, 0.2–1.6 wt. % copper 1.8–3.5 wt. % lithium, 1.4–6 wt. % magnesium, 0.2 wt. % iron, up to 1 wt. % manganese and up to 0.35 wt. % zinc. The aluminum based alloy of Dubost et al supposedly demonstrates high specific mechanical properties, a low density and good resistance to corrosion.

U.S. Pat. No. 4,526,630 to Field discloses an aluminum based alloy which includes 0.4 wt. % silicon, 0.5–2 wt. % copper, 1–3 wt. % lithium, 0.2–2 wt. % magnesium and 0.4 wt. % iron. The aluminum based alloy of Field supposedly demonstrates improved mechanical properties and the reduction in heat sensitivity.

U.S. Pat. No. 4,735,774 to Narayanan et al discloses an aluminum based alloy which includes 0.12 wt. % silicon, 1.6 wt. % copper, 2.5 wt. % lithium, 1.0 wt. % magnesium 0.15 wt. % iron, 0.05 wt. % manganese and 0.25 wt. % zinc. The aluminum based alloy of Narayanan et al supposedly demonstrates good fracture toughness and relatively high strength.

The present invention is an improvement over the prior art aluminum based alloys and provides an aluminum-lithium alloy having superior characteristics which are ideally suitable for particular applications, including high temperature applications such as mechanical pistons in internal combustion engines.

DISCLOSURE OF THE INVENTION

It is accordingly one object of the present invention to provide an improved lithium containing aluminum based alloy product.

It is another object of the present invention to provide an improved aluminum-lithium alloy product having improved mechanical properties and density reduction, which is especially suitable for use in high temperature applications such as mechanical pistons in internal combustion engines.

In accordance with the above objects and advantages, the present invention provides, in its broadest embodiment, a low density aluminum-based alloy, consisting essentially of the formula $$Al_{bal}Si_aCu_bLi_cMg_dFe_eMn_fNi_gZn_hAg_iTi_j$$

wherein bal refers to the balance of the composition and a, b, c, d, e, f, g, h, i, and j are each greater than 0.00.

In one embodiment, the present invention provides an aluminum alloy having improved strength and a reduced density which consists essentially of 10–20 wt. % silicon(a), 1.5–5.0 wt. % copper(b), 1.0–4.0 wt. % lithium(c), 0.45–1.5 wt. % magnesium(d), 0.01–1.3 wt. % iron(e), 0.01–0.5 wt. % manganese(f), 0.01–1.5 wt. % nickel(g), 0.01–1.5 wt. % zinc(h), 0.01–0.5 wt. % silver(i), 0.01–0.25 wt. % titanium(j) and the balance aluminum.

This alloy product is utilized for casting high temperature assemblies including pistons which have a reduction in density as compared to similar alloys and exhibit similar mechanical properties.

DESCRIPTION OF THE PREFERRED EMBODIMENTS

In one embodiment, the aluminum-based alloy-wrought product of the present invention consists essentially of 10–20 wt. % silicon, 1.5–5.0 wt. % copper, 1.0–4.0 wt. % lithium, 0.45–1.5 wt. % magnesium, 0.01–1.3 wt. % iron, 0.01–0.5 wt. % manganese, 0.01–1.5 wt. % nickel, 0.01–1.5 wt. % zinc, 0.01–0.5 wt. % silver, 0.01–0.25 wt. % titanium and the balance aluminum. In a more preferred embodiment, the aluminum based alloy will contain about 2 wt. % lithium, for instance, 1.79 to 1.99 wt. %, which alloy has a density reduction as compared to similar alloys of approximately 9.83%. The aluminum-lithium based alloy may be readily prepared from a starting material which includes aluminum-lithium wrought scrap.

The aluminum-lithium alloy of the present invention is particularly distinguished from prior art alloys by its ability to perform in cast form. One application ideally suitable for the aluminum-lithium alloy of the present invention is cast pistons for internal combustion engines, especially high specific output engines where engine operating temperatures are higher than usual. Other applications for use of the alloy include engine blocks, cylinder heads, compressor bodies, and other areas where service under high temperatures is required. The alloy may give particularly good service in high temperature diesel engines. Still other applications include brake calipers and brake drums which are subjected to high temperatures during use.

The aluminum-lithium alloy of the invention is formulated in the proportions set forth in the foregoing paragraphs and processed into articles utilizing known techniques. The alloy is formulated into molten form, by conventional methods of blending and applying heat to the dry components in a suitable crucible or furnace, and cast into ingots or directly cast into product molds. According to a feature of the present invention, melt scrap containing copper, magnesium, lithium and the balance aluminum, is a particularly suitable starting material for producing the final alloy after the addition of other components and heating to a molten form.

A particularly suitable method for preparation of the alloys of the invention is by modification of the registered alloys 339 and B390 by addition of lithium. Alloy B390 is registered with the Aluminum Association, Inc., and has the following composition in wt. %: 16.0–18.0 Si, 1.3 Fe max, 4.0–5.0 Cu, 0.5 Mn max, 0.45–0.65 Mg, 0.1.5 Zn max, and 0.20 Ti max. This alloy may also include up to 0.1 Ni. Alloy 339 is registered with the Aluminum Association, Inc., and has the following composition in wt. %: 11.0–13.0 Si, up to 12 Fe, 1.5–3.0 Cu, up to 0.5 Mn, 0.50–1.5 Mg, 0.50–1.5 Ni, up to 1.0 Zn, and up to 0.25 Ti.

The amount of lithium to be added is about 1.0–4.0 wt. % although best results are obtained by additions of about 2 wt. %. In these alloys it is also preferable that the Si content in atomic percent should be kept greater than the Li level to ensure that formation of an (AlLi) phase does not occur.

The alloys of the present invention may be cast in the temperature range of from about 1,250° F. to about 1,500° F. They are mainly intended to be cast into approximate shape and machined or ground to final dimension. However, other forming operations, can be employed. A solution heat treatment followed by artificial aging may be employed which may improve the strength. A suitable artificial aging involves heating the alloy to a temperature of between 300° F. to 500° F. for one to 24 hours. The solution heat treatment followed by artificial aging is particularly preferred as it may develop improved properties.

The following Examples are presented to illustrate the invention which is not intended to be considered as being limited thereto. In the Examples, and throughout, percentages are by weight, unless otherwise indicated.

EXAMPLE 1

In this Example, tensile tests were completed on two groups of aluminum-lithium alloys. One group of alloys was B390 registered alloy with a 2% lithium addition. The other alloy group was 339 registered alloy with a 2% lithium addition. The B390 alloy samples had an average tensile strength of 16.4 KSI. The 339 alloy with 2% lithium had an average tensile strength of 11.7 KSI. None of the samples had enough curve in the elongation graph to calculate the yield strength. The elongation of all the samples was less than 1%. Test data from the individual samples may be found in Table I below.

TABLE I

| Sample | Thickness Diameter (Inches) | Area (Inches) | Load (Pounds) | Ultimate Tensile Stress (KSI) | Elongation (% in 2") |
|---|---|---|---|---|---|
| | | | 390-AL—Li Alloy 2% | | |
| 1 | Nom. .5 | .1963 | 4,190 | 21.3 | −1% |
| 2 | Nom. .5 | .1963 | 4,010 | 20.4 | −1% |
| 3 | Nom. .5 | .1963 | 3,780 | 19.2 | −1% |
| 4 | Nom. .5 | .1963 | 3,200 | 16.3 | −1% |
| 5 | Nom. .5 | .1963 | 4,320 | 22.0 | −1% |
| 6 | Nom. .5 | .1963 | 3,240 | 16.5 | −1% |
| 7 | Nom. .5 | .1963 | 3,460 | 17.5 | −1% |
| 8 | Nom. .5 | .1963 | 3,355 | 17.1 | −1% |
| 9 | Nom. .5 | .1963 | 2,810 | 14.3 | −1% |
| 10 | Nom. .5 | .1963 | 1,255 | 6.4 | −1% |
| 11 | Nom. .5 | .1963 | 2,375 | 12.1 | −1% |
| 12 | Nom. .5 | .1963 | 2,550 | 13.0 | −1% |
| | | | AVG | 16.4 | |
| | | | 339-AL—Li Alloy 2% Li | | |
| 1 | Nom. .5 | .1963 | 1,785 | 9.1 | −1% |
| 2 | Nom. .5 | .1963 | 2,080 | 10.6 | −1% |
| 3 | Nom. .5 | .1963 | 2,400 | 12.2 | −1% |
| 4 | Nom. .5 | .1963 | 2,150 | 10.9 | −1% |
| 5 | Nom. .5 | .1963 | 2,780 | 14.1 | −1% |
| 6 | Nom. .5 | .1963 | 1,790 | 9.1 | −1% |
| 7 | Nom. .5 | .1963 | 2,450 | 12.5 | −1% |
| 8 | Nom. .5 | .1963 | 1,890 | 9.6 | −1% |
| 9 | Nom. .5 | .1963 | 2,610 | 13.3 | −1% |
| 10 | Nom. .5 | .1963 | 2,080 | 10.6 | −1% |
| 11 | Nom. .5 | .1963 | 2,290 | 11.6 | −1% |
| 12 | Nom. .5 | .1963 | 2,735 | 13.9 | −1% |
| 13 | Nom. .5 | .1963 | 2,500 | 12.7 | −1% |
| 14 | Nom. .5 | .1963 | 2,640 | 13.4 | −1% |
| | | | Avg. | 11.7 | |

EXAMPLE 2

In this example, wrought scrap was melted having a nominal composition of 5 wt. % copper, 0.4 wt. % magnesium, 1.25 wt. % lithium, 0.4 wt. % silver, about 0.13 wt. % zirconium, and the balance aluminum. Sixteen test bars were cast having compositions set forth in Table II below.

TABLE II

| Al—Li Piston Alloy Development Composition | |
|---|---|
| Element | % |
| Si | .03 |
| Fe | .03 |
| Cu | 5.01 |
| Mn | <.01 |
| Mg | .25 |
| Cr | <.01 |
| Ni | <.01 |
| Zn | .02 |
| Ti | .02 |
| Li | .96 |
| Zr | .11 |
| Ag | .48 |

The tensile tests on this group of aluminum lithium alloy test bars were conducted for comparison purposes and the alloys were found to have an average tensile strength of 12.65 KSI. The elongation average was less than 1%. Individual sample data may be found in Table III below:

TABLE III

| Sample | Thickness Diameter (Inches) | Area (Inches) | Load (Pounds) | Ultimate Tensile Stress (KSI) | Elongation (% in 2") |
|---|---|---|---|---|---|
| | | AL—Li Scrap From M.L. | | | |
| 1 | .504 | .199 | 3,635 | 18.26 | 1%— |
| 2 | .501 | .197 | 2,520 | 12.79 | 1%— |
| 3 | .502 | .198 | 3,335 | 16.84 | 1%— |
| 4 | .501 | .197 | 2,405 | 12.2 | 1%— |
| 5 | .498 | .195 | 2,240 | 11.48 | 1%— |
| 6 | .498 | .195 | 2,335 | 11.97 | 1%— |
| 7 | .500 | .196 | 2,165 | 11.04 | 1%— |
| 8 | .498 | .195 | 1,780 | 9.12 | 1%— |
| 9 | .498 | .195 | 2,880 | 14.51 | 1%— |
| 10 | .499 | .1955 | 2,050 | 10.48 | 1%— |
| 11 | .499 | .1955 | 2,250 | 11.5 | 1%— |
| 12 | .497 | .194 | 2,840 | 14.63 | 1%— |
| 13 | .498 | .195 | 1,835 | 9.41 | 1%— |
| 14 | .497 | .194 | 2,410 | 12.42 | 1%— |
| 15 | .497 | .194 | 1,720 | 8.86 | 1%— |
| 16 | .498 | .195 | 3,315 | 17.0 | 1%— |
| | | | Avg. | 12.65 | |

EXAMPLE 3

In this example, wrought scrap was melted having a nominal composition of 5 wt. % Cu, 0.4 wt. % Mg, 1.25 wt. % Li, 0.4 wt. % Ag, and 0.13 wt. % Zr, with the balance aluminum. Forty test bars were cast, four without silicon additions for comparison, and 36 with 2.5% silicon addition. The chemical compositions are set forth in Table IV below:

TABLE IV

| Element | Before Si Addition | First Sample Before Casting | Last Sample After Casting |
|---|---|---|---|
| | Aluminum—Lithium Alloy Development - Composition (Wt. %) | | |
| Si | .04 | 2.49 | 2.54 |
| Fe | .04 | .06 | .07 |
| Cu | 5.18 | 4.97 | 4.95 |
| Mn | <.01 | — | — |
| Mg | .32 | .30 | .28 |
| Cr | <.01 | — | — |
| Ni | <.01 | — | — |
| Zn | .02 | .02 | .02 |
| Ti | .02 | .02 | .02 |
| Li | 1.09 | 1.11 | 1.01 |
| Zr | .11 | .11 | .11 |
| Ag | .47 | .48 | .46 |

The tensile tests on selected samples of this group of aluminum-lithium alloy test bars were conducted and the alloy was found to have an average tensile strength of 21.8 KSI. The elongation average was about 1%. Individual sample data may be found in Table V. The area of each sample was 0.1987 inch.

TABLE V

| Sample No. | Tensile Load (Pounds) | Strength (Stress KSI) |
|---|---|---|
| 1 | 5,035 | 25.3 |
| 2 | 4,951 | 25.0 |
| 3 | 4,910 | 24.7 |
| 4 | 4,830 | 24.3 |
| 5 | 4,880 | 24.5 |
| 6 | 4,780 | 24.0 |
| 7 | 4,430 | 22.3 |
| 8 | 4,230 | 21.3 |
| 9 | 4,085 | 20.5 |
| 10 | 4,270 | 21.5 |
| 11 | 3,980 | 20.0 |
| 12 | 3,310 | 16.6 |
| 13 | 4,045 | 20.3 |
| 14 | 3,020 | 15.2 |

EXAMPLE 4

In this example, samples of B390 alloy both unrefined and phosphorus refined, and 339 alloy, both modified and unmodified, were cast into test bars and tested for tensile strength, yield strength and elongation for comparison purposes. The results of these tests of the standard alloys are given in Table VI below:

TABLE VI

| Sample | Thickness Diameter (Inches) | Area (Inches) | Tensile Strength Load (Pounds) | Tensile Strength Stress (KSI) | Yield Strength .1% Offset Load (Pounds) | Yield Strength .1% Offset Stress (KSI) | Elongation (% in 2") |
|---|---|---|---|---|---|---|---|
| | | | 390 Unrefined | | | | |
| 1 | Nom. .5 | .19635 | 6180 | 31.4 | 5350 | 27.2 | 1% |
| 2 | Nom. .5 | .19635 | 4650 | 23.6 | — | 27.5 | 1% |
| 3 | Nom. .5 | .19635 | 5600 | 28.5 | 5400 | 27.5 | 1% |
| 4 | Nom. .5 | .19635 | 5620 | 28.6 | 5400 | 27.5 | 1% |
| 5 | Nom. .5 | .19635 | 6115 | 31.1 | 5450 | 27.7 | 1% |
| 6 | Nom. .5 | .19635 | 5210 | 26.5 | — | | 1% |
| 7 | Nom. .5 | .19635 | 5310 | 27.0 | — | | 1% |
| 8 | Nom. .5 | .19635 | 5540 | 28.2 | — | | 1% |
| 9 | Nom. .5 | .19635 | 4870 | 24.8 | — | | 1% |
| 10 | Nom. .5 | .19635 | 5205 | 26.5 | — | | 1% |
| 11 | Nom. .5 | .19635 | 5810 | 29.5 | — | | 1% |
| 12 | Nom. .5 | .19635 | 5875 | 29.9 | — | | 1% |
| 13 | Nom. .5 | .19635 | 5410 | 27.5 | — | | 1% |
| 14 | Nom. .5 | .19635 | 5530 | 28.1 | — | | 1% |
| 15 | Nom. .5 | .19635 | 5815 | 29.6 | — | | 1% |

TABLE VI-continued

| | | | | | | | | |
|---|---|---|---|---|---|---|---|---|
| 16 | Nom. .5 | .19635 | 5600 | 28.5 | — | | | 1% |
| 17 | Nom. .5 | .19635 | 5630 | 28.6 | — | | | 1% |
| 18 | Nom. .5 | .19635 | 6275 | 31.9 | — | | | 1% |
| 19 | Nom. .5 | .19635 | 6190 | 31.5 | — | | | 1% |
| 20 | Nom. .5 | .19635 | 6180 | 31.4 | — | | | 1% |
| | | | AVG | 27.6 | | Avg. | 27.5 | |
| | | | 390 (P.Cu) Phos. Refined | | | | | |
| 1 | Nom. .5 | .19635 | 6120 | 31.1 | 5350 | | 27.2 | −1% |
| 2 | Nom. .5 | .19635 | 5495 | 27.9 | 5350 | | 27.2 | −1% |
| 3 | Nom. .5 | .19635 | 5640 | 28.7 | 5300 | | 26.9 | −1% |
| 4 | Nom. .5 | .19635 | 5355 | 27.2 | 5350 | | 27.2 | −1% |
| 5 | Nom. .5 | .19635 | 6025 | 30.6 | 5260 | | 26.7 | −1% |
| 6 | Nom. .5 | .19635 | 5270 | 26.8 | 5175 | | 26.3 | −1% |
| 7 | Nom. .5 | .19635 | 6150 | 31.3 | 5500 | | 28.0 | −1% |
| 8 | Nom. .5 | .19635 | 6305 | 32.1 | 5550 | | 28.2 | −1% |
| 9 | Nom. .5 | .19635 | 5875 | 29.9 | 5250 | | 26.7 | −1% |
| 10 | Nom. .5 | .19635 | 6235 | 31.7 | 5750 | | 29.2 | −1% |
| 11 | Nom. .5 | .19635 | 6390 | 32.5 | 5650 | | 28.7 | −1% |
| 12 | Nom. .5 | .19635 | 5860 | 29.8 | 5800 | | 29.5 | −1% |
| 13 | Nom. .5 | .19635 | 6690 | 34.0 | 5700 | | 29.0 | −1% |
| 14 | Nom. .5 | .19635 | 6340 | 32.2 | 5750 | | 29.2 | −1% |
| 15 | Nom. .5 | .19635 | 6270 | 31.9 | 5500 | | 28.0 | −1% |
| 16 | Nom. .5 | .19635 | 5365 | 27.3 | — | | — | −1% |
| 17 | Nom. .5 | .19635 | 5940 | 30.2 | 5900 | | 30.0 | −1% |
| 18 | Nom. .5 | .19635 | 5770 | 29.3 | — | | — | −1% |
| 19 | Nom. .5 | .19635 | 5610 | 28.5 | 5600 | | 28.5 | −1% |
| 20 | Nom. .5 | .19635 | 6115 | 31.4 | — | | — | −1% |
| | | | AVG | 30.2 | | Avg. | 28.0 | |

| Sample | Thickness Diameter (Inches) | Area (Inches) | Tensile Strength Load (Pounds) | Tensile Strength Stress (KSI) | Yield Strength .2% Offset Load (Pounds) | Yield Strength .2% Offset Stress (KSI) | Elongation (% in 2") |
|---|---|---|---|---|---|---|---|
| | | | 339 (Sr) Modified | | | | |
| 1A | Nom. .5 | .19635 | 6190 | 31.5 | 4450 | 22.6 | 1% |
| 1B | Nom. .5 | .19635 | 5765 | 29.3 | 4400 | 22.4 | 1% |
| 2A | Nom. .5 | .19635 | 6115 | 31.1 | 4400 | 22.4 | 1% |
| 2B | Nom. .5 | .19635 | 5785 | 29.4 | 4270 | 21.7 | 1% |
| 3A | Nom. .5 | .19635 | 5335 | 27.1 | 4150 | 21.1 | 1% |
| 3B | Nom. .5 | .19635 | 5210 | 26.5 | 4175 | 21.2 | 1% |
| 4A | Nom. .5 | .19635 | 5180 | 26.3 | 4150 | 21.1 | 1% |
| 4B | Nom. .5 | .19635 | 4575 | 23.3 | 4100 | 20.8 | 1% |
| 5A | Nom. .5 | .19635 | 5225 | 26.6 | 4050 | 20.6 | 1% |
| 5B | Nom. .5 | .19635 | 5035 | 25.6 | 4100 | 20.8 | 1% |
| 6A | Nom. .5 | .19635 | 5035 | 25.6 | 4150 | 21.1 | 1% |
| 6B | Nom. .5 | .19635 | 5555 | 28.2 | 4200 | 21.3 | 1% |
| 7A | Nom. .5 | .19635 | 4820 | 24.5 | 4150 | 21.1 | 1% |
| 7B | Nom. .5 | .19635 | 4790 | 24.3 | 4270 | 21.7 | 1% |
| 8A | Nom. .5 | .19635 | 5320 | 27.0 | 4170 | 21.2 | 1% |
| 8B | Nom. .5 | .19635 | 4865 | 24.7 | 4370 | 22.2 | 1% |
| 9A | Nom. .5 | .19635 | 5160 | 26.2 | 4150 | 21.1 | 1% |
| 9B | Nom. .5 | .19635 | 5555 | 28.2 | 4250 | 21.6 | 1% |
| 10A | Nom. .5 | .19635 | 5210 | 26.5 | 4250 | 21.6 | 1% |
| 10B | Nom. .5 | .19635 | 5200 | 26.4 | 4260 | 21.6 | 1% |
| | | | AVG | 26.9 | AVG | 21.5 | |
| | | | 339 Unmodified | | | | |
| 1 | Nom. .5 | .19635 | 5480 | 27.9 | 3920 | 19.9 | 1% |
| 2 | Nom. .5 | .19635 | 5500 | 28.0 | 4000 | 20.3 | 1% |
| 3 | Nom. .5 | .19635 | 5570 | 28.3 | 4010 | 20.4 | 1% |
| 4 | Nom. .5 | .19635 | 4670 | 23.7 | 4250 | 21.6 | 1% |
| 5 | Nom. .5 | .19635 | 5290 | 26.9 | 4410 | 22.4 | −1% |
| 6 | Nom. .5 | .19635 | 4775 | 24.3 | 4520 | 23.0 | 1% |
| 7 | Nom. .5 | .19635 | 4865 | 24.7 | 4400 | 22.4 | 1% |
| 8 | Nom. .5 | .19635 | 4880 | 24.8 | 4420 | 22.5 | 1% |
| 9 | Nom. .5 | .19635 | 5185 | 26.4 | 4350 | 22.1 | 1% |
| 10 | Nom. .5 | .19635 | 5440 | 27.7 | 4370 | 22.2 | 1% |
| 11 | Nom. .5 | .19635 | 5465 | 27.8 | 4425 | 22.5 | 1% |
| 12 | Nom. .5 | .19635 | 5225 | 26.6 | 4500 | 22.9 | 1% |
| 13 | Nom. .5 | .19635 | 5050 | 25.7 | 4425 | 22.5 | 1% |
| 14 | Nom. .5 | .19635 | 5790 | 29.4 | 4600 | 23.4 | 1% |
| 15 | Nom. .5 | .19635 | 5590 | 28.4 | 4400 | 22.4 | 1% |
| 16 | Nom. .5 | .19635 | 5520 | 28.1 | 4620 | 23.5 | 1% |
| 17 | Nom. .5 | .19635 | 5915 | 30.1 | 4575 | 23.3 | 1% |
| 18 | Nom. .5 | .19635 | 5615 | 28.5 | 4675 | 23.8 | 1% |
| 19 | Nom. .5 | .19635 | 5000 | 25.4 | 4600 | 23.4 | 1% |
| 20 | Nom. .5 | .19635 | 5115 | 26.0 | 4825 | 24.5 | 1% |
| | | | AVG | 28.2 | AVG | 23.7 | |

In this example, the unrefined B390 alloy samples were found to have an average tensile strength of 27.6 KSI. The phosphorous refined B390 alloy samples were found to have an average tensile strength of 30.2 KSI. The unmodified 339 alloy samples were found to have an average tensile strength of 28.2 KSI. The modified 339 alloy samples were found to have an average tensile strength of 26.9 KSI.

Although the invention has been described with reference to particularly means, materials and embodiments, from the foregoing description, one skilled in the art could ascertain the essential characteristics of the present invention and various changes and modifications may be made to adapt the various uses and characteristics thereof without departing from the spirit and the scope of the present invention as described in the claims that follow.

What is claimed is:

1. A low density aluminum alloy consisting essentially of the following components:

| | |
|---|---|
| Si | 10–20 wt. % |
| Cu | 1.5–5.0 wt. % |
| Li | 1.0–4.0 wt. % |
| Mg | 0.45–1.5 wt. % |
| Fe | 0.01–1.3 wt. % |
| Mn | 0.01–0.5 wt. % |
| Ni | 0.01–1.5 wt. % |
| Zn | 0.01–1.5 wt. % |

-continued

| | |
|---|---|
| Ag | 0.01–0.5 wt. % |
| Ti | 0.01–0.25 wt. % |
| Al | balance. |

2. A low density aluminum-based alloy according to claim 1, wherein Li is about 2.

3. An aluminum-based article made from a low density aluminum-based alloy consisting essentially of the formula $$Al_{bal}Si_aCu_bLi_cMg_dFe_eMn_fNi_gZn_hAg_iTi_j$$

wherein bal refers to the balance of the composition and a, b, c, d, e, f, g, h, i and j are each greater than 0.00 weight percent wherein $10 \leqq a \leqq 20$, $1.5 \leqq b \leqq 5.0$, $1.0 \leqq c \leqq 4.0$, $0.45 \leqq d \leqq 1.5$, $0.1 \leqq e \leqq 1.3$, $0.01 \leqq f \leqq 0.5$, $0.01 \leqq g \leqq 1.5$, $0.01 \leqq h \leqq 1.5$, $0.01 \leqq i \leqq 0.5$, $0.01 \leqq j \leqq 0.25$.

4. An aluminum-based article according to claim 3, wherein c is about 2.

5. An aluminum-based article according to claim 3, wherein said article is selected from the group consisting of engine blocks, pistons, cylinder heads, compressor bodies, brake calipers and brake drums.

6. An aluminum-based article according to claim 3, wherein said article is cast or forged from said aluminum-based alloy.

* * * * *